US008167294B2

(12) United States Patent
Yahata

(10) Patent No.: US 8,167,294 B2
(45) Date of Patent: May 1, 2012

(54) TRAY, SHEET POST-PROCESSING APPARATUS, AND SHEET-ALIGNMENT METHOD

(75) Inventor: Isao Yahata, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 133 days.

(21) Appl. No.: 12/695,832

(22) Filed: Jan. 28, 2010

(65) Prior Publication Data

US 2010/0194024 A1 Aug. 5, 2010

Related U.S. Application Data

(60) Provisional application No. 61/150,245, filed on Feb. 5, 2009.

(30) Foreign Application Priority Data

Jun. 30, 2009 (JP) ..... 2009-155125

(51) Int. Cl.
*B65H 9/04* (2006.01)

(52) U.S. Cl. ..... 270/58.27; 270/58.12; 270/58.17; 270/59

(58) Field of Classification Search ..... 270/58.01, 270/58.07, 58.11, 58.12, 58.17, 58.27, 59; 271/213, 214
See application file for complete search history.

(56) References Cited

U.S. PATENT DOCUMENTS

| | | | | |
|---|---|---|---|---|
| 5,022,641 | A * | 6/1991 | Okada | 271/3.08 |
| 6,352,253 | B1 | 3/2002 | Hayakawa et al. | |
| 6,634,641 | B2 * | 10/2003 | Yamakawa et al. | 271/220 |
| 7,392,983 | B2 * | 7/2008 | Kodama et al. | 271/249 |
| 2008/0067730 | A1 | 3/2008 | Suzuki et al. | |
| 2008/0075510 | A1 | 3/2008 | Kubo et al. | |
| 2011/0085840 | A1 * | 4/2011 | Shiohara | 400/578 |

FOREIGN PATENT DOCUMENTS

| | | | |
|---|---|---|---|
| JP | 8-301511 | A | 11/1996 |
| JP | 2007-137668 | A | 6/2007 |

OTHER PUBLICATIONS

Chinese Office Action dated Oct. 19, 2011, filed in Chinese counterpart Application No. 201010118649.5, 15 pages (with English translation).

* cited by examiner

*Primary Examiner* — Leslie A Nicholson, III
(74) *Attorney, Agent, or Firm* — Patterson & Sheridan, LLP

(57) ABSTRACT

According to one embodiment, a tray includes a take on surface on which a sheet is placed, a projecting portion configured to stick out from the take on surface, and a slip stopper including a sheet-slip stopper portion having a larger frictional coefficient with the sheet than the take on surface has. The slip stopper sticks the sheet-slip stopper portion out from the take on surface when the sheet comes into contact with the projecting portion.

10 Claims, 8 Drawing Sheets

TRAY, SHEET POST-PROCESSING APPARATUS, AND SHEET-ALIGNMENT METHOD

CROSS-REFERENCE TO RELATED APPLICATION

This application is based upon and claims the benefit of priority from U.S. provisional application 61/150,245 filed on Feb. 5, 2009, the entire contents of all of which are incorporated herein by reference.

This application is also based upon and claims the benefit of priority from Japanese Patent Application No. 2009-155125, filed on Jun. 30, 2009, the entire contents of all of which are incorporated herein by reference.

TECHNICAL FIELD

Exemplary embodiments described herein relates to a tray on which sheets are placed, a sheet post-processing apparatus including the tray, and a method of aligning a sheet on the tray.

BACKGROUND

Image forming apparatuses and sheet post-processing apparatuses include various trays, such as a processing tray for placing a sheet after image formation to bring the sheet to post-processing, and a receiving tray for receiving a discharged sheet after image formation or after post-processing. With a size reduction of the apparatuses, the processing tray and the receiving tray tend to have a shorter length in the sheet conveying direction. In other words, a sheet conveyed to a tray more easily slips on the tray because the tray only has a small area for supporting the conveyed sheet. Therefore, there arises a problem that the sheet conveyed to the tray goes out of alignment.

In particular, the processing tray included in a sheet post-processing apparatus is required to stack sheets in an accurately aligned manner in order to bind the sheets together after the sheets are discharged on the tray. JP-A 2007-137668 discloses a device which serves as means for maintaining alignment of the sheets on the processing tray, and which performs longitudinal alignment and crosswise alignment of the sheets.

The frictional force between a tray and a sheet is smaller than the frictional force between two sheets. Accordingly, a first sheet conveyed to the tray tends to slip on the tray more easily than a second or subsequent sheet conveyed to the tray. The first conveyed sheet is sometimes discharged obliquely on the tray, and is displaced. In addition, the first conveyed sheet is sometimes dragged to be displaced by the movement of the second or subsequent sheet.

As described above, the first sheet on the tray tends to be largely moved away from the intended position. There is a risk that the fist sheet may drop off from the receiving tray of an image forming apparatus or of a sheet post-processing apparatus. In addition, the processing tray of a sheet post-processing apparatus cannot completely eliminate misalignment of the sheets only by performing sheet alignment disclosed in JP-A 2007-137668, and problematic post-processing operations such as stapling are performed on the sheets still misaligned.

SUMMARY

An aspect of the present disclosure relates to a tray comprising: a take on surface on which a sheet is placed; a projecting portion configured to stick out from the take on surface; and a slip stopper including a sheet-slip stopper portion having a larger frictional coefficient with the sheet than the take on surface has, the slip stopper sticking the sheet-slip stopper portion out from the take on surface when the sheet comes into contact with the projecting portion.

Another aspect of the present disclosure relates to a sheet post-processing apparatus comprising: a post-processing portion configured to perform a post-processing on a sheet conveyed to the post-processing portion; a tray including: a take on surface on which the sheet is placed; a projecting portion configured to stick out from the take on surface; and a slip stopper including a sheet-slip stopper portion configured to prevent the sheet from slipping by coming into contact with the sheet, the slip stopper sticking the sheet-slip stopper portion out from the take on surface when the sheet comes into contact with the projecting portion.

Another aspect of the present disclosure relates to a method of aligning a sheet on a tray comprising: dropping a sheet onto a take on surface of the tray; bringing the sheet into contact with a projecting portion of a slip stopper provided in the take on surface while the sheet is falling; and sticking a sheet-slip stopper portion of the slip stopper out from the take on surface in response to an event the sheet comes into contact with the projecting portion, and thereby bringing the sheet-slip stopper portion into contact with the sheet.

DETAILED DESCRIPTION

Figure 1:
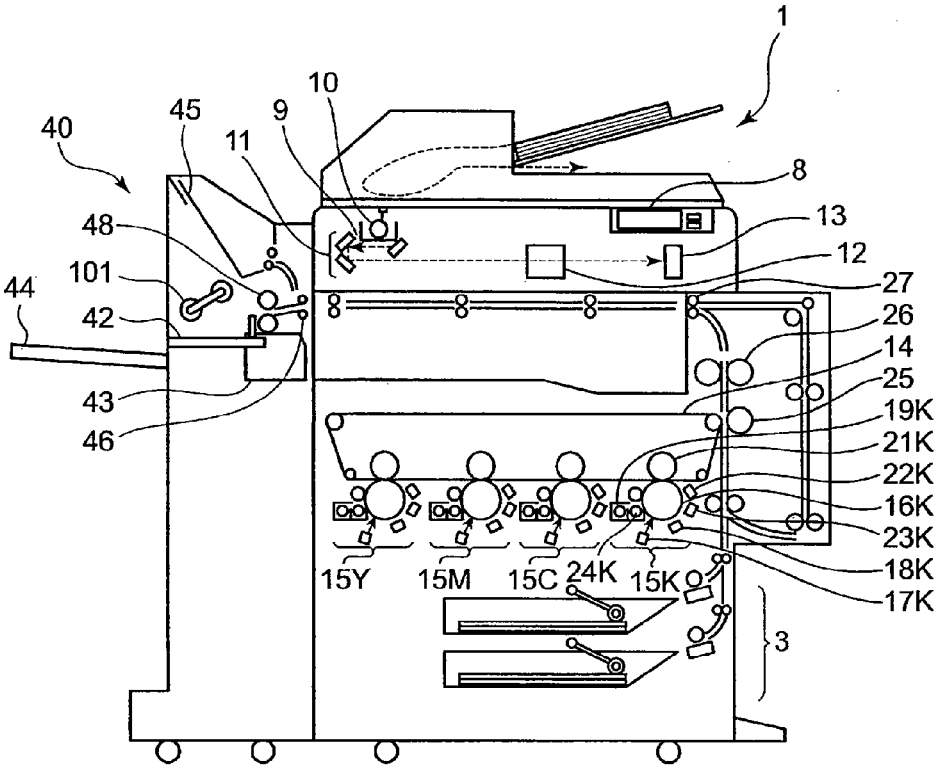
FIG. 1 is a sectional view illustrating the internal structure of a sheet post-processing apparatus and an image forming apparatus.

Hereinafter, embodiments will be described by referring to the drawings.

(First Embodiment) A first embodiment will be described by referring to FIGS. 1 to 6.

FIG. 1 is a sectional view illustrating the internal structure of a sheet post-processing apparatus and an image forming apparatus.

An image forming apparatus 1 includes an image forming portion 2 configured to output an output image based on image information. The image forming apparatus 1 also includes a sheet supply portion 3 configured to supply sheets P of an arbitrary size to the image forming portion 2, where an output image is formed on the sheets P. The image forming apparatus 1 also includes an image reading portion 4 configured to acquire, as image data, image information from an original document, the image information used by the image forming portion 2 as base data to form an image.

The image reading portion 4 includes a transparent document table 8, a carriage 9, an exposure lamp 10, a mirror 11, an imaging lens 12, and a CCD (Charge Coupled Device) 13. The imaging lens 12 is configured to condense beams of reflect light. The CCD 13 is configured to convert image information into analog signals, the image information obtained by capturing light from the reflect light.

The image forming portion 2 includes an intermediate transfer belt 14 serving as a transfer member. The image forming portion 2 also includes four process units 15Y, 15M, 15C, and 15K which are in a line adjacent to each other along the intermediate transfer belt 14, and which correspond respectively to toners of yellow (Y), magenta (M), cyan (C), and black (K).

All these process units have identical configurations, and work similarly. Accordingly, the following description is given by taking the process unit 15K for the black (K) color as an example.

The process unit 15K includes a photoreceptor 16K serving as an image carrier, and a laser unit 17K configured to form an electrostatic latent image on the photoreceptor 16K. The process unit 15K also includes a charger 18K, a developing device 19K, a primary transfer device 21K, a cleaner 22K, and a neutralization lamp 23K, all of which are arranged in sequence so as to surround the photoreceptor 16K. The primary transfer device 21K is positioned so as to be opposed to the photoreceptor 16K with the intermediate transfer belt 14 interposed therebetween.

An original document is placed on the document table 8, or is fed to the document table 8 by an automatic document feeder 30. Light is emitted onto the original document from below the document table 8 by an exposure unit including the carriage 9 and the exposure lamp 10 mounted on the carriage 9. The reflection light from the original document is directed by the mirror 11, and is then condensed by the imaging lens 12. Thus, a reflect-light image is projected to the CCD 13. Image information taken in the CCD 13 is outputted in the form of analog signals, which are then converted into digital signals. The digital signals are subjected to image processing operations, and the resultant signals are sent to the laser unit 17K.

Once the image forming portion 2 starts forming images, the charger 18K supplies electric charge to the outer circumferential surface of the rotating photoreceptor 16K. The outer circumferential surface of the photoreceptor 16K is thus charged uniformly to a certain potential. Laser beams are emitted onto the outer circumferential surface of the photoreceptor 16K by the laser unit 17K in accordance with the image information sent from the CCD 13. An electrostatic latent image corresponding to the image information is formed on the outer circumferential surface of the photoreceptor 16K by the emission of the laser beams. Then, developing agent is provided to the outer circumferential surface of the photoreceptor 16K by the developing device 19K, and thus the electrostatic latent image is converted into a toner image.

The developing device 19K includes a rotatable developing roller 24K. While the developing roller 24K facing the photoreceptor 16K is rotating, toner is supplied to the photoreceptor 16K. The toner image formed on the outer circumferential surface of the photoreceptor 16K is then electrostatically transferred to the intermediate transfer belt 14 by the primary transfer device 21K. The toner not transferred and thus remains on the outer circumferential surface of the photoreceptor 16K is removed by the cleaner 22K, which is positioned at the downstream side of the primary transfer device 21K in the rotational direction of the photoreceptor 16K. In addition, the residual electric charge on the outer circumferential surface of the photoreceptor 16K is removed by the neutralization lamp 23K. If a color image is formed, the series of operations described above are performed similarly in each of the process units 16Y, 16M, and 16C.

The toner image transferred to the intermediate transfer belt 14 is then electrostatically transferred, by a secondary transfer device 25, to a sheet P conveyed from the sheet supply device through the sheet conveyor route. The sheet P with the toner image transferred thereon is conveyed to a fixing device 26, and is fixed onto the sheet P by the fixing device 26. Once the toner image fixed onto the sheet P and thus the formation of image on the sheet P is completed, the sheet P is conveyed to conveyor rollers 27.

The sheet P on which image formed in the above-described way is discharged from the image forming apparatus 1 by the conveyor rollers 27, and is sent to a sheet post-processing apparatus 40.

Subsequently, the sheet post-processing apparatus 40 will be described.

The sheet post-processing apparatus 40 basically includes a processing tray 42, a stapler 43, a first receiving tray 44, and a second receiving tray 45.

The sheet P introduced into the sheet post-processing apparatus 40 by entrance rollers 46 positioned at the connecting portion to the sheet-discharge port of the image forming apparatus 1 is conveyed to the processing tray 42 by a pair of conveyor rollers 48.

The processing tray 42 supports and aligns the sheets P stacked on the processing tray 42 while the sheets P are stapled by the stapler 43, which is a processing mechanism to perform the post-processing. The sheets P post-processed by the stapler 43 are discharged to the first receiving tray 44.

On the other hand, the sheets P not post processed are conveyed to the second receiving tray 45 by the entrance rollers 46.

Subsequently, the structure and the operation of a slip stopper 201 mounted on the tray will be described by referring to FIGS. 2 to 4. The slip stopper 201 can be provided on each of the first receiving tray 44, the second receiving tray 45, and the processing tray 42. Hereafter, the above-mentioned three trays are collectively referred to as a tray 200.

Figure 2:
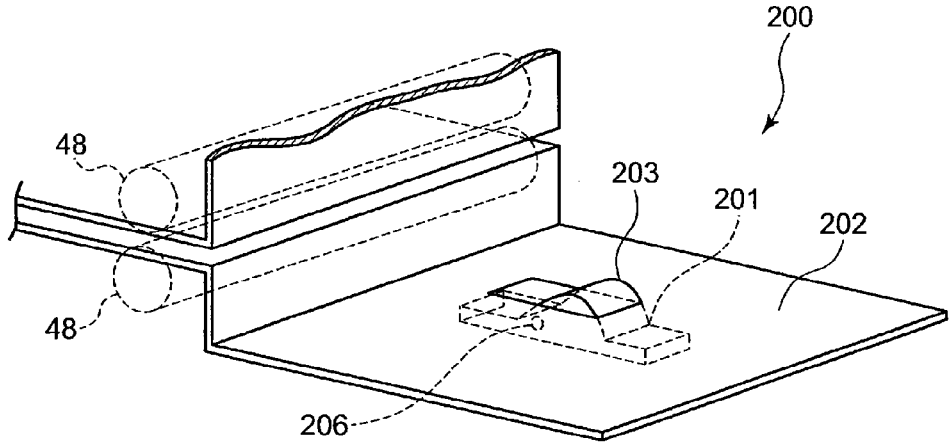
FIG. 2 is a perspective view illustrating a tray according to a first embodiment.

FIG. 2 is a perspective view illustrating the tray 200 provided with the slip stopper 201. FIG. 3 is a sectional view illustrating the tray 200. FIGS. 4A and 4B are sectional views each illustrating the operation of the slip stopper 201.

As FIG. 2 shows, the slip stopper 201 is positioned in the central portion of the tray 200. As FIG. 3 shows, a first opening 202*a* and a second opening 202*b* are formed in a take on surface 202 on which the sheets are stacked. The slip stopper 201 includes a portion which sticks out of the take on surface 202 upwards from below through the first opening 202*a* (hereafter, referred to as a projecting portion 203).

Figure 3:
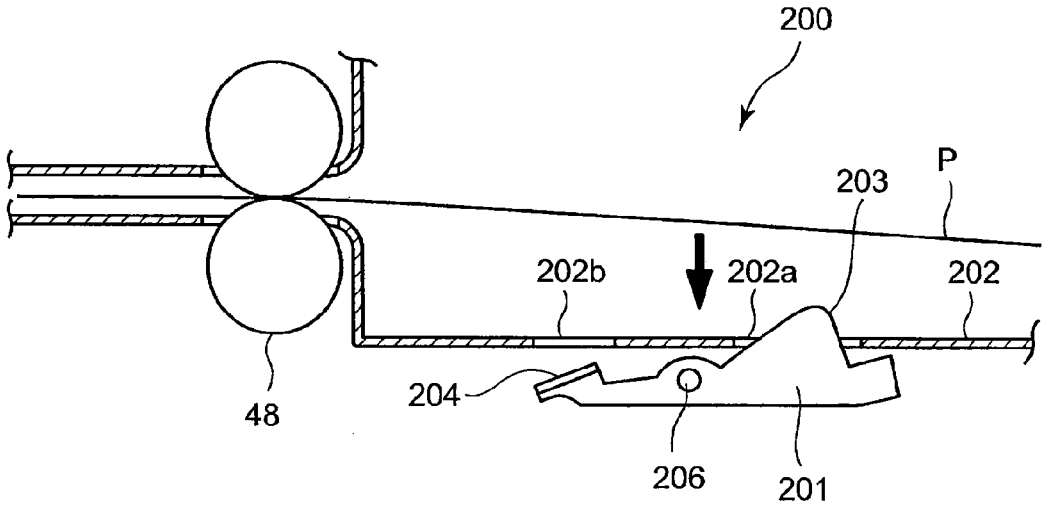
FIG. 3 is a sectional view illustrating the tray according to the first embodiment.
Figure 4A:
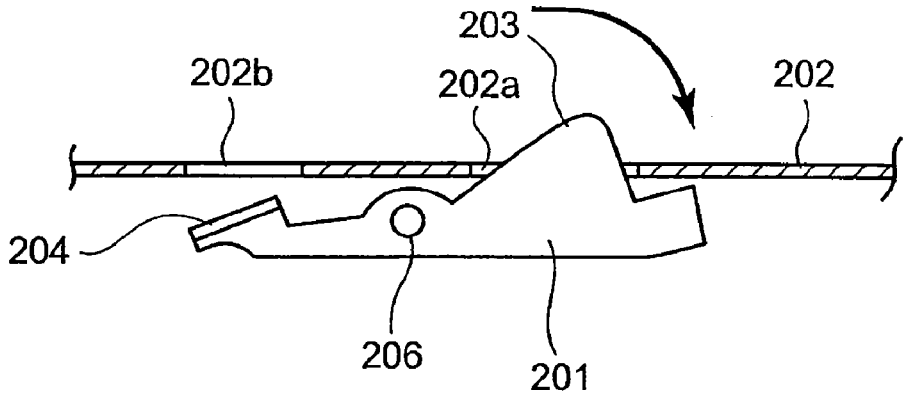
FIGS. 4A and 4B are sectional views each illustrating an operation mechanism of a slip stopper according to the first embodiment.
Figure 4B:
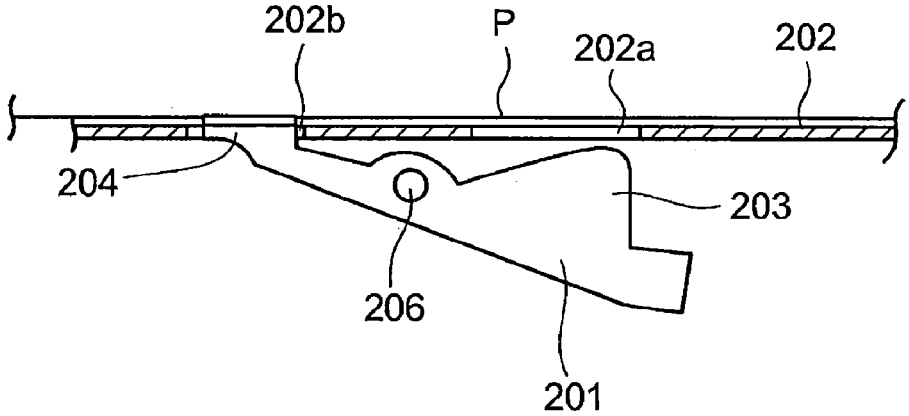

In a case where there is no sheet P on the tray 200 and the first sheet P conveyed by the conveyor rollers 48 falls down onto the tray 200 as the arrow in FIG. 3 indicates. When the first sheet P falls down onto the tray 200, the projecting portion 203 is pushed, by the weight of the sheet P, downwards through the first opening 202*a* formed in the take on surface 202. The projecting portion 203 thus pushed downwards turns the slip stopper 201 about a fulcrum 206 in the direction indicated by the arrow in FIG. 4A.

The rotational motion of the slip stopper 201 about the fulcrum 206 allows a contacting portion 204 serving as a sheet-slip stopper portion (hereafter, the sheet-slip stopper portion will be referred to as the contacting portion 204) to stick out of the second opening 202*b* from the take on surface 202. The slip stopper 201 serves also as the actuator to allow the contacting portion 204 to stick out of the second opening 202*b* from the take on surface 202. The contacting portion 204 is formed so that the surface of the contacting portion 204 can generate a larger frictional coefficient with the sheet P than the take on surface 202 does with the sheet P.

In the case of the processing tray 42, a post processing such as the stapling is performed after the detection of presence or absence of a sheet on the take on surface 202. The detection of presence or absence of a sheet on the take on surface 202 is necessary. The sheet presence or absence detection can be performed using the slip stopper 201.

Figure 5A:
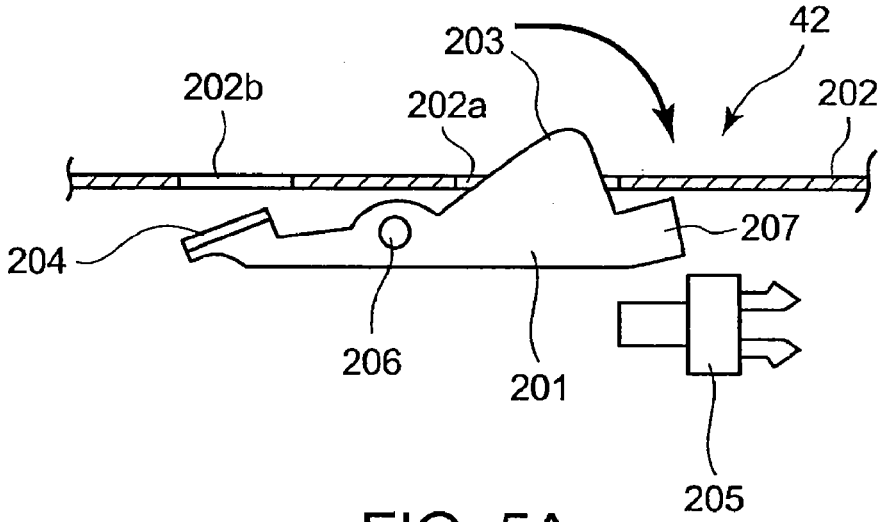
FIGS. 5A and 5B are sectional views each illustrating a processing tray including the slip stopper according to the first embodiment.
Figure 5B:
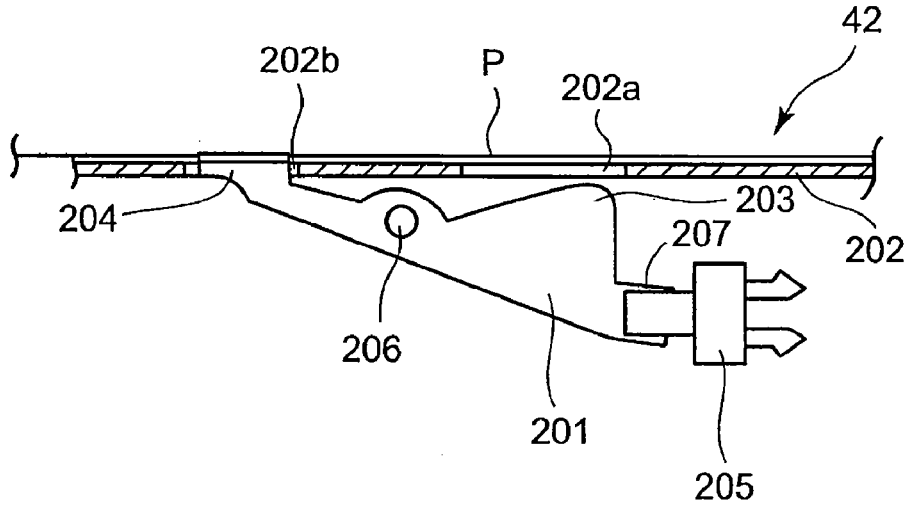

FIGS. 5A and 5B are sectional views each illustrating the operation of the slip stopper 201 provided on the processing tray 42. As FIG. 5A shows, a sheet sensor 205 including a photosensor is arranged under the processing tray 42. As FIG. 5B shows, when the sheet P conveyed to the processing tray 42 pushes down the projecting portion 203, the slip stopper 201 moves rotationally, so that a light shielding portion 207 formed in an end portion of the slip stopper 201 shields the sheet sensor 205 from the light. Presence or absence of a sheet on the processing tray 42 can be detected using the slip stopper 201.

With the above-described configuration, the first sheet P conveyed to the tray 200 while there is no sheet P on the tray 200 can be prevented from slipping on the surface of the tray 200. In other words, the alignment of the sheets P conveyed to the tray 200 can be improved.

In addition, the slip stopper 201 serves both as the actuator to allow the contacting portion 204 to stick out and, in the case of the processing tray 42, as a part of the system to detect presence or absence of a sheet on the processing tray 42. Accordingly, the apparatus as a whole can be simplified without employing any additional member.

Figure 6A:
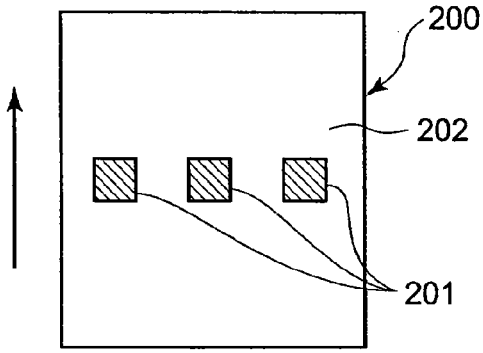
FIGS. 6A to 6C are plan views each illustrating a tray equipped with plural slip stoppers.
Figure 6B:
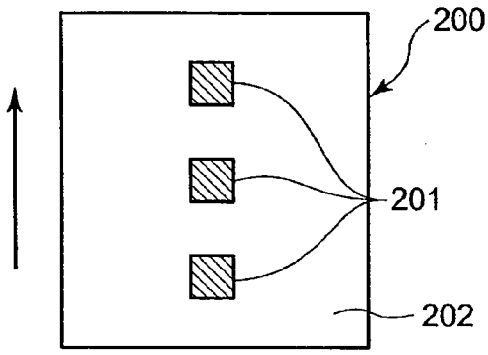
Figure 6C:
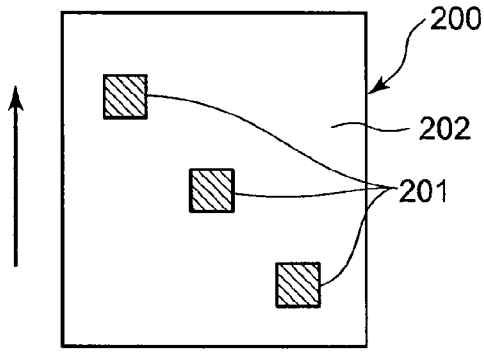

In the first embodiment, only a single slip stopper 201 is provided on the take on surface 202 of the tray 200. Plural slip stoppers 201 may be provided instead. FIGS. 6A to 6C are diagrams each illustrating an example of how the plural slip stoppers 201 can be arranged on the take on surface 202 of the tray 200.

In the example shown in FIG. 6A, plural slip stoppers 201 are arranged in line along a direction perpendicular to the sheet conveying direction. The slip stoppers 201 arranged are effective in preventing the misalignment of the sheet P in a sheet-width direction.

In the example shown in FIG. 6B, plural slip stoppers 201 are arranged in line along the sheet conveying direction. The slip stoppers 201 arranged are effective in preventing the misalignment of the sheet P in a longitudinal direction.

In the example shown in FIG. 6C, plural slip stoppers 201 are arranged in line along a diagonal line of the tray 200. The slip stoppers 201 arranged are effective in preventing the misalignment of the sheet P caused by the rotational motion of the sheet P.

As described above, if plural slip stoppers 201 are provided on the tray 200, different effects can be achieved by different ways of arranging the plural slip stoppers 201.

While the sheet P is being discharged to the tray 200, the leading end of the sheet P is sometimes brought into contact with the contacting portion 204. If such a contact happens, the sheet P being discharged can be prevented from sliding on the surface of the tray 200 by the contact of the leading end of the sheet P with the contacting portion 204, whereby the sheet P prevented from sliding may cause a paper jam.

In the tray 200 of the first embodiment, however, the contacting portion 204 does not appear out on the bottom surface of the tray 200 while the sheet P is being discharged. Accordingly, the paper jam caused by the contact of the leading end of the sheet P with the contacting portion 204 while the sheet P is being discharged can be prevented from occurring in the above-mentioned way. If the projecting portion 203 and the contacting portion 204 are located at positions closer to the conveyor rollers 48 than the landing point of the leading end of the sheet P on the tray 200 is, the paper jam can be avoided more effectively.

(Second Embodiment) A second embodiment of the invention will be described by referring to FIGS. 7 to 9.

Hereafter, the same portions as those of the first embodiment are denoted by the same reference numerals, and description will be given of only characteristic portions of the second embodiment.

In the second embodiment, a processing tray 42 includes a function to align sheets P in the sheet conveying direction and in the direction perpendicular to the sheet conveying direction. The slip stopper 201 is provided on the processing tray 42.

To begin with, the operation of aligning sheets P performed by the processing tray 42 will be described by referring to FIG. 7.

Figure 7A:
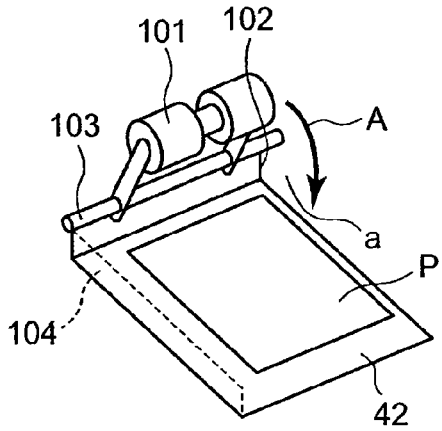
FIGS. 7A to 7C are perspective views each illustrating a sheet aligning operation by an aligning roller.
Figure 7B:
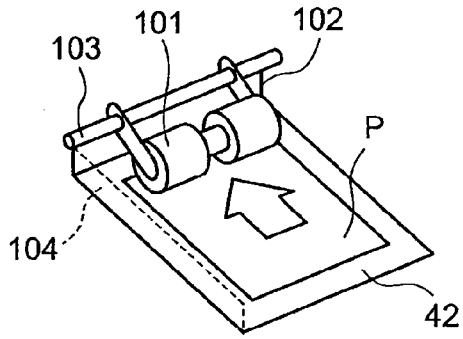
Figure 7C:
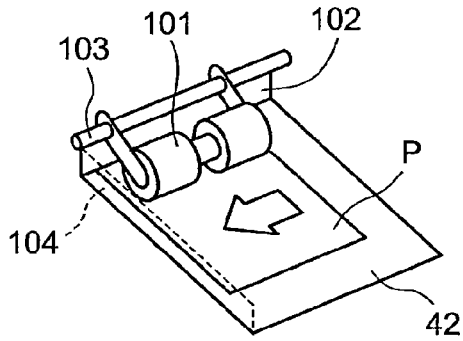

As FIG. 7A shows, an alignment roller 101 is arranged above the processing tray 42. The alignment roller 101 is capable of being lifted up or brought down. The sheet P conveyed to the processing tray 42 is aligned by the alignment roller 101 both in the sheet conveying direction (in a longitudinal direction) and in the direction perpendicular to the sheet conveying direction (in a crosswise direction).

Once the sheet P is conveyed to the processing tray 42, the alignment roller 101 positioned above the processing tray 42 is brought down onto the sheet P. In other words, the arrow A in FIG. 7A indicates the direction of the motion of the alignment roller 101. While the alignment roller 101 is in contact with the top surface of the sheet P, the alignment roller 101 rotates so as to move the sheet P in the direction indicated by the arrow in FIG. 7B. The sheet P thus moved is brought into contact with a back-end stopper 102, and thereby is aligned in the longitudinal direction of the sheet P. The back-end stopper 102 extends in the direction perpendicular to the sheet conveying direction, and forms a plane of the processing tray 42.

While the alignment roller 101 is still in contact with the top surface of the sheet P, the alignment roller 101 moves along a shaft 103 so as to get closer to a sidewall 104. The movement of the alignment roller 101 brings a side end, in the sheet-width direction, of the sheet P into contact with the sidewall 104, so that the sheet P is aligned in the crosswise direction.

When the sheet P is conveyed to the processing tray 42, the alignment roller 101 starts moving and aligns the sheet P both in the longitudinal direction and in the sheet-width direction. All the sheets P conveyed to the processing tray 42 are aligned. The above-described operation of aligning the sheet P in the longitudinal direction and in the sheet-width direction is disclosed in Japanese Patent Application Publication No. 2007-137668.

The sheet P conveyed to the processing tray 42 while there is no sheet P on the processing tray 42 (i.e., the first sheet P)

is prevented from slipping on the processing tray 42 by the slip stopper 201 mounted on the processing tray 42 before the aligning operation.

Subsequently, the slip stopper 201 in the second embodiment will be described by referring to FIGS. 8 and 9.

Figure 8:
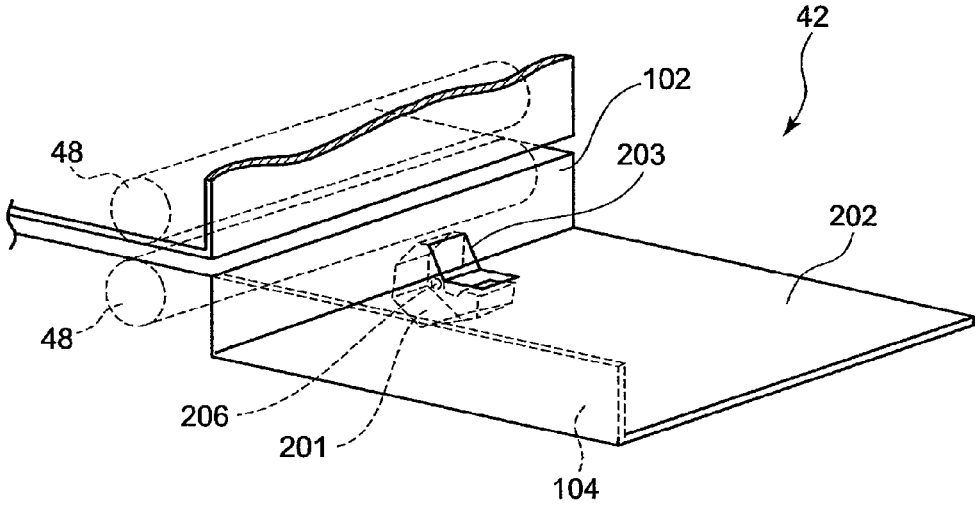
FIG. 8 is a perspective view illustrating a processing tray according to a second embodiment.
Figure 9:
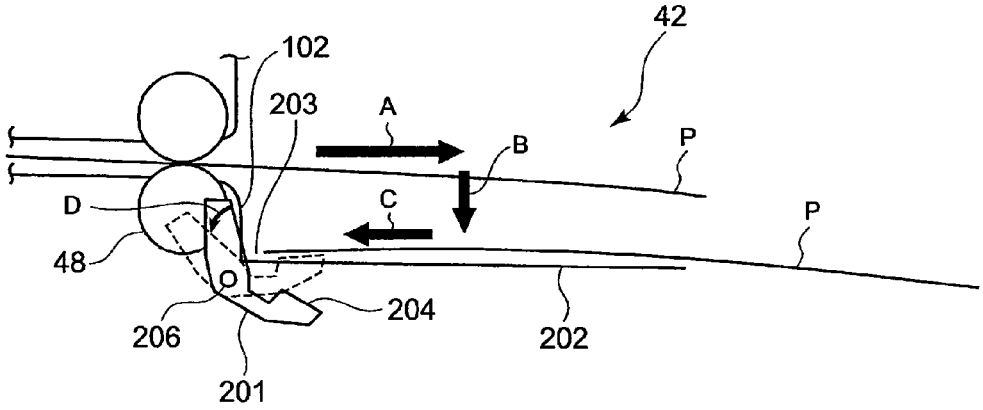
FIG. 9 is a sectional view illustrating an operation mechanism of a slip stopper according to the second embodiment.

FIG. 8 is a perspective view illustrating the processing tray 42. FIG. 9 is a sectional view illustrating the processing tray 42. In the second embodiment, the operation of aligning the sheet P in the longitudinal direction responds to the sticking-out motion of the contacting portion 204.

As FIG. 8 shows, the slip stopper 201 is arranged on the back-end stopper 102, specifically in the central portion thereof in the direction perpendicular to the sheet conveying direction. The slip stopper 201 includes a projecting portion 203 configured to stick out over the take on surface 202 from the back-end stopper 102.

Subsequently, the operation of the slip stopper 201 will be described by referring to FIG. 9.

If a sheet P is conveyed to the processing tray 42 being empty, the sheet P is aligned in the longitudinal direction by the alignment roller 101. The sheet P moves firstly in the direction indicated by the arrow A in FIG. 9, then in the direction indicated by the arrow B, and then in the direction indicated by the arrow C.

In the aligning of the sheet P in the longitudinal direction, the sheet P moves in the direction indicated by the arrow C, and thus the back end of the sheet P is brought into contact with the back-end stopper 102. In the aligning of the sheet P in the longitudinal direction, the sheet P is brought into contact also with the projecting portion 203 of the slip stopper 201 provided in the back-end stopper 102. The contact of the sheet P with the projecting portion 203 turns the slip stopper 201 about a fulcrum 206 in the direction indicated by the arrow D. The turning of the slip stopper 201 allows the contacting portion 204 to stick out upward from the take on surface 202.

With the above-described configuration, the contacting portion 204 of the slip stopper 201 can stick out from the surface of the processing tray 42 so as to respond to the longitudinal alignment of the sheet P conveyed to the processing tray 42. Accordingly, the first sheet P can be prevented from slipping on the processing tray 42.

In the second embodiment, only a single slip stopper 201 is provided in the back-end stopper 102, but plural slip stoppers 201 may be provided adjacent to one another in the back-end stopper 102. The plural slip stoppers 201, if provided, can prevent the first sheet P from slipping more effectively, and can prevent the sheets P from misaligning on the processing tray 42.

(Third Embodiment) A third embodiment of the invention will be described by referring to FIGS. 10 and 11.

Hereafter, the same portions as those of the above-mentioned embodiments are denoted by the same reference numerals, and description will be given of only characteristic portions of the third embodiment.

Figure 10:
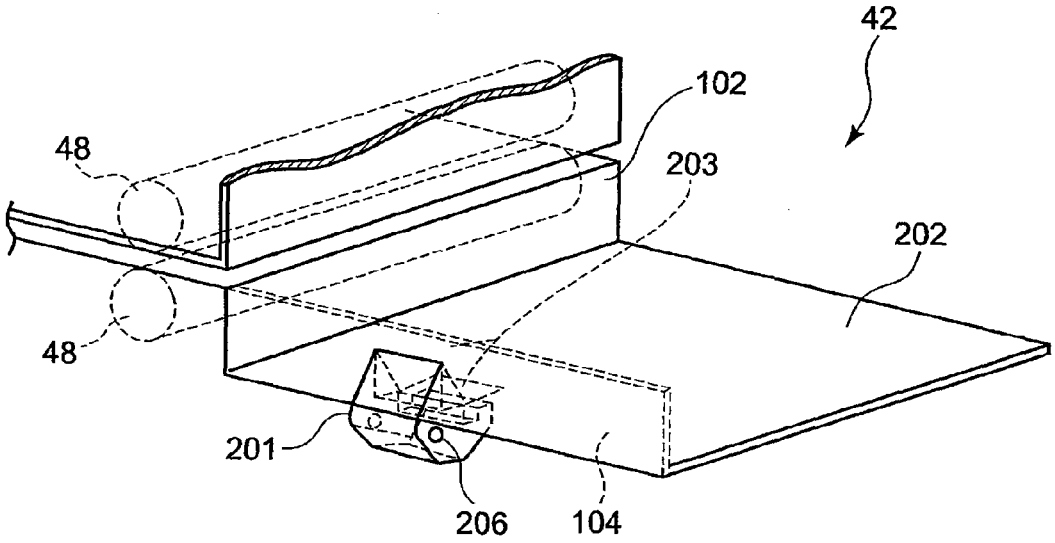
FIG. 10 is a perspective view illustrating a processing tray according to a third embodiment.
Figure 11:
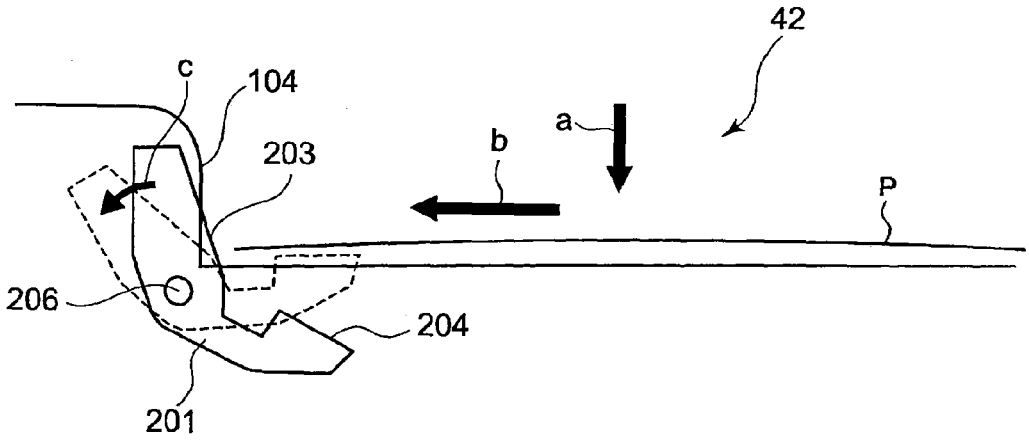
FIG. 11 is a sectional view illustrating an operation mechanism of a slip stopper according to the third embodiment.

FIG. 10 is a perspective view illustrating a processing tray 42 according to the third embodiment. FIG. 11 is a sectional view illustrating the processing tray 42. In the third embodiment, the crosswise alignment operation is interlinked with the sticking-out motion of a contacting portion 204 of the slip stopper 201.

As FIG. 10 shows, the slip stopper 201 is provided on the sidewall 104, specifically in the central portion thereof in the sheet conveying direction. The slip stopper 201 includes a projecting portion 203 configured to stick out over the take on surface 202 from the sidewall 104.

In the aligning of the sheet P in the crosswise direction, a side end of the sheet P is brought into contact with the sidewall 104. In the aligning of the sheet P in the crosswise direction, the sheet P is brought into contact also with the projecting portion 203 of the slip stopper 201 provided in the sidewall 104. The contact of the sheet P with the projecting portion 203 turns the slip stopper 201 about a fulcrum 206 in the direction indicated by the arrow c. The turning of the slip stopper 201 allows the contacting portion 204 to stick out upward from the take on surface 202.

With the above-described configuration, the contacting portion 204 of the slip stopper 201 can stick out upward from the surface of the processing tray 42 so as to respond to the crosswise alignment of the sheet P conveyed to the processing tray 42. Accordingly, the first sheet P can be prevented from slipping on the processing tray 42.

In the third embodiment, only a single slip stopper 201 is provided in the sidewall 104, but plural slip stoppers 201 may be provided in the sidewall 104. The plural slip stoppers 201, if provided, can prevent the first sheet P from slipping more effectively, and can prevent the sheets P from misaligning on the processing tray 42.

What is claimed is:

1. A tray comprising:

a take on surface on which a sheet is placed;

a projecting portion configured to stick out from the take on surface; and a slip stopper including a sheet-slip stopper portion having a larger frictional coefficient with the sheet than the take on surface has, and a fulcrum between the projecting portion and the sheet-slip stopper portion, the slip stopper rotating about the fulcrum to cause the sheet-slip stopper portion to stick out from the take on surface when the sheet comes into contact with the projecting portion so as to push the projecting portion.

2. The tray according to claim 1, wherein a plurality of the slip stoppers are provided, and arranged in a direction perpendicular to a sheet conveying direction.

3. The tray according to claim 1, wherein a plurality of the slip stoppers are provided, and arranged in a sheet conveying direction.

4. The tray according to claim 1, wherein a plurality of the slip stoppers are provided, and arranged in a direction along a diagonal line of the tray.

5. The tray according to claim 1 further comprising:

a longitudinal alignment member configured to align the sheet in a sheet conveying direction, wherein the slip stopper is provided in a surface of the tray, the surface extending in a direction perpendicular to the sheet conveying direction, and when the sheet aligned in the sheet conveying direction by the longitudinal alignment member comes into contact with the projecting portion, the slip stopper causes the sheet-slip stopper portion to stick out from the take on surface.

6. The tray according to claim 5, wherein a back end of the sheet is brought into contact with the projecting portion when the sheet is aligned by the longitudinal alignment member.

7. The tray according to claim 1 further comprising:

a crosswise alignment member configured to align the sheet in a direction perpendicular to a sheet conveying direction, wherein the slip stopper is provided in one of side surfaces of the tray, the side surfaces extending in a direction parallel with the sheet conveying direction, and when the sheet aligned in the direction perpendicular to the sheet conveying direction by the crosswise alignment member comes into contact with the projecting portion, the slip stopper causes the sheet-slip stopper portion to stick out from the take on surface.

8. The tray according to claim 7, wherein a side end of the sheet is brought into contact with the projecting portion when the sheet is aligned by the crosswise alignment member.

9. The tray according to claim 1, wherein the presence or absence of a sheet on the take on surface is detected based on whether or not the sheet-slip stopper portion is sticking out from the take on surface.

10. The tray according to claim 9, wherein the slip stopper includes a light shielding portion at an end of the slip stopper, and when the slip stopper rotates about the fulcrum to cause the sheet-slip stopper portion to stick out from the take on surface, the light shielding portion shields a photosensor from light, and thereby the presence or absence of the sheet on the take on surface is detected.

* * * * *